US005887493A

United States Patent [19]

Main

[11] Patent Number: 5,887,493

[45] Date of Patent: Mar. 30, 1999

[54] RATCHET WRENCH

[76] Inventor: Harvey M. Main, 8626-301 Rd., Parachute, Colo. 81635

[21] Appl. No.: 682,393

[22] Filed: Jul. 17, 1996

Related U.S. Application Data

[63] Continuation of Ser. No. 274,895, Jul. 14, 1994, abandoned.

[51] Int. Cl.[6] ..... B25B 17/00

[52] U.S. Cl. ..... 81/57.29; 87/63

[58] Field of Search ..... 81/57.29, 58.1, 81/63

[56] References Cited

U.S. PATENT DOCUMENTS

| | | | |
|---|---|---|---|
| 633,880 | 9/1899 | Miller . | |
| 1,601,767 | 10/1926 | Peterson . | |
| 2,512,232 | 6/1950 | Hart . | |
| 2,565,961 | 8/1951 | Godfrey . | |
| 2,701,490 | 2/1955 | Griparis . | |
| 2,703,030 | 3/1955 | Marvin . | |
| 2,720,296 | 10/1955 | Briglia . | |
| 2,891,434 | 6/1959 | Lozensky . | |
| 3,044,591 | 7/1962 | Kilness . | |
| 3,208,318 | 9/1965 | Roberts . | |
| 3,233,481 | 2/1966 | Bacon . | |
| 3,290,969 | 12/1966 | Berquist et al. . | |
| 3,342,229 | 9/1967 | Janes . | |
| 3,393,587 | 7/1968 | Joliff et al. . | |
| 3,467,231 | 9/1969 | Haznar . | |
| 3,650,165 | 3/1972 | Wolfe . | |
| 3,659,484 | 5/1972 | Scodeller . | |
| 3,707,893 | 1/1973 | Hofman . | |
| 3,733,936 | 5/1973 | Flynn | 81/57.29 X |
| 3,823,624 | 7/1974 | Martin . | |
| 3,881,376 | 5/1975 | Wright . | |
| 4,053,037 | 10/1977 | Solomon . | |
| 4,086,829 | 5/1978 | Hudgins . | |
| 4,128,025 | 12/1978 | Main et al. | 81/58.1 |
| 4,147,076 | 4/1979 | Wright et al. . | |
| 4,211,127 | 7/1980 | D'Oporto et al. . | |
| 4,218,940 | 8/1980 | Main | 81/63 |
| 4,406,186 | 9/1983 | Gummow | 81/60 |
| 4,520,697 | 6/1985 | Moetteli . | |
| 4,546,676 | 10/1985 | Kiefer . | |
| 4,791,837 | 12/1988 | Main . | |
| 4,807,500 | 2/1989 | Main . | |
| 5,005,448 | 4/1991 | Main . | |

*Primary Examiner*—James G. Smith
*Attorney, Agent, or Firm*—Timothy J. Martin; Michael R. Henson

[57] ABSTRACT

A wrench of the ratchet type which can rotatably advance a first workpiece about a second workpiece in a ratchet condition by angularly moving a handle thereof or in a condition disengaged from the ratchet condition by rotating an end portion of a drive shaft extending from the handle. Additionally, the present invention includes a socket ejection mechanism which is operative with the drive shaft.

26 Claims, 5 Drawing Sheets

RATCHET WRENCH

This is a continuation of application Ser. No. 08/274,895 filed on Jul. 14, 1994, now abandoned.

FIELD OF INVENTION

The present invention generally relates to ratchet tools. More particularly, the present invention is directed to a ratchet wrench which can rotatably advance a first workpiece about a second workpiece in a ratchet condition by angularly moving a handle thereof or in a condition disengaged from the ratchet condition by rotating an end portion of a drive shaft extending from the handle. Additionally, the present invention includes a socket ejection mechanism which is operative with the drive shaft.

BACKGROUND OF THE INVENTION

In the past, many different types of ratchet wrenches have been developed to rapidly advance a first workpiece such as a nut onto or off of a second workpiece such as a bolt. Of particular interest are two ratchet wrenches described in my patents, U.S. Pat. No. 4,128,025 and U.S. Pat. No. 4,218,940. My U.S. Pat. No. 4,128,025 discloses an improved ratchet wrench that has a selectable ratcheting action to rotate an annular driver member in either direction by angularly moving an elongated handle. This ratchet wrench includes a three position ratchet pawl switch that has a first position to effect ratcheting action in one direction, a second position to effect ratcheting action in the opposite direction and a third position to effect disengagement of the ratcheting action. A drive shaft is slidably and rotatably disposed within a bore of the handle and extends outwardly from a distal end of the handle so that the annular driver member can be rotated in either direction when the ratchet pawl switch is in the third position. The pawl is pivotally connected within a housing of the ratchet wrench by a pivot pin. A select one of a pair of shoulders engages peripheral teeth of the annular driver member. Since the length of the peripheral teeth of the annular driver member is greater than the length of each of the shoulders of the pawl element, only a portion of the peripheral teeth is utilized to effect ratcheting action. A spring ball assembly cooperates with a pair of annular grooves formed into the drive shaft to resiliently retain the drive shaft either in a ratcheting condition or a condition disengaged from the ratcheting condition. A set screw fasten to the housing of the ratchet wrench retains the spring ball assembly therein in its working state. A sleeve carrying a pair of beveled gears and a disk element is slidably received onto and connected to an end portion of the drive shaft within the housing of the ratchet wrench. The sleeve is secured to the end portion of the drive shaft by a second set screw.

My U.S. Pat. No. 4,218,940 discloses a ratchet wrench having features similar to the ratchet wrench described in my U.S. Pat. No. 4,128,025. However, my U.S. Pat. No. 4,218,940 describes a ratchet wrench having a socket release mechanism. The socket release mechanism enables the annular driver member to engage and disengage a socket by linearly urging the drive shaft into the handle and the cavity of the housing. A first portion of the shaft is circular in cross-section and extends through and outwardly of the handle. A second portion of the drive shaft extends into a cavity of the housing and has a square cross-section or a rounded cross-section with a slot and key arrangement so that a sleeve having a pair of beveled gears and a disk element can rotate simultaneously with the drive shaft. The second portion of the drive shaft slidably receives the sleeve. The sleeve houses a spring which resiliently biases the sleeve into the cavity of the housing and the drive shaft outwardly of the handle. The end of the drive shaft extending into the cavity of the housing includes a conically-shaped element which contacts a plunger of the socket release mechanism. When the drive shaft is resiliently urged into the handle and cavity, the conically-shaped element urges the plunger into a central opening formed in the annular driver member to cause a ball to recess therein, thus, releasing the socket.

Despite the advantages associated with the ratchet wrenches described in my patents, neither of the ratchet wrenches is sealed. Thus, unwanted materials, such as dust particles and water, can infiltrate the cavity of the housing and the bore of the handle. Due to the variety of features of my ratchet wrenches, the pawl element is diminished in thickness at the shoulders which limits the torque which can be applied without shearing the ratchet teeth from the annular driver member or the shoulders from the pawl element. Further, a pin is used so that the pawl element can pivot within the cavity of the housing, and such pins can wear out and sometimes break. Also, the biasing element positions the pawl element in either a first or a second ratchet condition. The biasing element is unable to resiliently retain the pawl element in a disengaged condition from the annular driver member. These ratchet wrenches rely upon a disk element to retain the pawl element in the disengaged condition. Also, the release mechanism described in my patent releases a retention force applied radially against the socket. The socket must then be either shaken from the stubshaft or removed by hand.

There is a need in the industry to provide a ratchet wrench which is simple to construct and assemble yet provide the advantages and features of the ratchet wrenches described hereinabove. It would be advantageous if such a ratchet wrench can be manufactured with a minimum of components such as by eliminating pivot pins and set screws. Also, there is a need in the industry to provide a more rugged ratchet wrench without limiting the features and benefits of currently existing ratchet wrenches. It would be advantageous if the length of the peripheral teeth of the annular driver member and the length of each shoulder of the pawl element be equal so that they can be fully engaged when operative. The present invention satisfies these needs and provides these advantages.

SUMMARY OF INVENTION

It is an object of the present invention to provide a new and improved ratchet wrench which can rotatably advance a first workpiece onto a second workpiece either by angularly moving a handle of the ratchet wrench or by rotating a drive shaft extending through and outwardly from the handle of the ratchet wrench.

It is another object of the present invention to provide a ratchet wrench that includes a socket ejection mechanism that is operative with the drive shaft to release and eject a conventional socket releasably engaged with an annular driver member of ratchet wrench.

Another object of the present invention is to provide a ratchet wrench that has a minimum number of components and is easy to manufacture and simple to assemble.

It is yet another object of the present invention is to provide a ratchet wrench that is sealed in order to inhibit infiltration of dust particles and water into the cavity of the housing and bore of the handle.

A still further object of the present invention is to provide a ratchet wrench having a cavity formed into the housing to rotatably receive the annular driver member and to pivotally receive the pawl element.

A still further object of the present invention is to provide a drive shaft of unitary construction which is operative with the pawl element to effect ratcheting action, with the annular driver member to effect rotation thereof and with the socket ejection mechanism to eject a conventional socket releasably connected to the annular driver member.

Yet another object of the present invention is to provide a ratchet wrench in which a spring ball assembly not only resiliently urges the shoulders of the pawl element into engagement with a select sequential pair of peripheral teeth, but also resiliently retains the pawl element in a disengaged condition when the drive shaft is appropriately rotated.

Yet another object of the present invention is to provide a ratchet wrench which includes a housing spring-ball assembly which is retained within the housing of the ratchet wrench by a cover plate.

According to the present invention, a ratchet wrench which is adapted for use to engage a first workpiece so that the first workpiece can be rotatably advanced about a second workpiece is hereinafter described. In its broadest form, the ratchet wrench of the present invention includes a annular drive member, a pawl element, a housing, an elongated handle and a drive shaft. The annular driver member is operative to matably engage the first workpiece and has a plurality of peripheral teeth and end teeth. The peripheral teeth are disposed circumferentially about the annular driver member and the end teeth are disposed circumferentially about and extend from an annular flat surface of the annular driver member parallel to an axis of rotation of the annular driver member. The pawl element has a pair of shoulders and a pair of nibs. Each of the shoulders is operative to matably engage sequential ones of the peripheral teeth of the annular driver member. The nibs project from a flat surface of the pawl element and extend parallel to a pivotal axis of the pawl element. The housing has a cavity which is divided into a first region and a second region. The first region is sized and configured to rotatably receive the annular driver member so that the peripheral teeth and the end teeth can rotate the axis of rotation. The second region is sized and configured to pivotally receive the pawl element when the annular driver member is rotatably received in the first region so that the nibs and the shoulders of the pawl element can articulate within the cavity. The handle has a proximal end which is connected to the housing and extends along a longitudinal axis from the proximal end to terminate in a free distal end. The handle has a bore extending longitudinally therethrough and in communication with the cavity of the housing.

The drive shaft is slidably and rotatably disposed within the bore of the handle along the longitudinal axis thereof. The drive shaft has a first end portion which extends outwardly relative to the free distal end of the handle and a second end portion which is disposed in the cavity of the housing. The drive shaft is operative in a first linear position and a second linear position. In the first linear position, rotating the first end portion of the drive shaft in a first direction causes the second end portion of the drive shaft to pivot the pawl element into either a first ratchet condition or a second ratchet condition. In the first ratchet condition, a first one of the shoulders of the pawl element engages the annular driver member so the moving the handle in a first angular direction advances the first workpiece in the first angular direction about the second workpiece and moving the handle in a second angular direction opposite the first angular direction causes selected ones of the peripheral teeth to sequentially move past the first one of the shoulders. Rotating the first end portion of the drive shaft in a second direction opposite the first direction causes the second end portion of the drive shaft to pivot the pawl element into the second ratchet condition. In the second ratchet condition, a second one of the pair of shoulders engages the annular driver member so that moving the handle in the first angular direction causes selected ones of the peripheral teeth to sequentially move past the second one of the shoulders and moving the handle in the second angular direction advances the first workpiece in the second angular direction about the second workpiece. In the second linear position, rotating the first end portion of the drive shaft causes the second end portion to engage the annular driver member so that rotating the first end portion in a clockwise direction simultaneously rotates the annular driver member in a counterclockwise direction thereby rotatably advancing the first workpiece in the counterclockwise direction. Also in the second linear position, rotating the first end portion in the counterclockwise direction simultaneously rotates the annular driver member in the clockwise direction thereby rotatably advancing the first workpiece in the clockwise direction.

The first shoulder of the pawl element is resiliently urged into engagement with select sequential ones of the peripheral teeth of the annular driver member when in the first ratchet condition. The second shoulder of the pawl element is resiliently urged into engagement with select sequential ones of peripheral teeth of the annular driver member when in the second ratchet condition. The housing includes a curved wall facing into the cavity which defines a pair of recesses. The pawl element includes an opening having a spring-ball assembly operative into the opening and cooperative with each of the recesses so that when the pawl element is in one of the first and second ratchet conditions, the spring-ball assembly resiliently urges respective ones of the shoulders of the pawl element into the engagement with select sequential ones of peripheral teeth of the annular driver member. Rotating the drive shaft in the first linear position between the first ratchet condition and the second condition defines a disengaged condition whereby the pawl element is disengaged from the annular driver member which can freely rotate within the cavity of the housing. It is preferred that the pawl element be resiliently retained in the disengaged condition.

The second end portion of the drive shaft includes a first gear and a second gear. The first and second gears are disposed about the longitudinal axis of the drive shaft for rotation. The first gear is operative to move the nibs of the pawl element so that the pawl element can move between the first ratchet condition and the second ratchet condition. The second gear is operative to matably engage the end teeth of the annular driver member so that the annular driver member can rotate when the first end portion of the drive shaft rotates. The second end portion of the drive shaft includes a disk element disposed between the first and second gears. The pawl element includes a pair of pins spaced apart from one another and extending parallel to the pair of nibs. The pair of pins operate to contact the disk element to restrict linear movement of the drive shaft when the first end portion of the drive shaft is moved from the first linear position to the second linear position.

The housing includes a housing spring-ball assembly while the drive shaft includes a pair of grooves extending circumferentially about the second end portion of the drive shaft and disposed adjacent to each other in a spaced-apart relationship. The housing spring-ball assembly and the pair of grooves are operative to cooperative with each other so that the drive shaft can be selectively and resiliently retained in one of the first linear position and the second linear position. The drive shaft includes an enlarged shaft portion extending longitudinally along and radially from the drive shaft within the bore. The enlarged shaft portion is disposed proximate to the second end portion of the drive shaft.

The ratchet wrench of the present invention includes a cover plate releasably connected to the housing. A gasket element is sized and adapted to be disposed between the housing and the cover plate when the cover plate is releasably connected thereto. The gasket is operative to inhibit unwanted materials from entering into the cavity. A spring clip is operative to releasably secure the cover plate onto the housing. The ratchet wrench of the present invention also includes a knob connected to the first end portion of the drive shaft. The knob is sized to extend partially into the bore of the handle. At least a portion of the knob extending outwardly from the bore is knurled. The knob is preferably configured to receive a tool element which is rotatably connected to a power tool device to automatically rotate the drive shaft when the drive shaft is disposed in the second linear position. The knob includes a clutch assembly operative to release upon imparting a select torsional force to the knob by the power tool device. The knob is cylindrically shaped and has a diameter larger than the drive shaft. It is also preferred that a knob seal element extends around the drive shaft proximate to the knob. The knob seal element is operative to inhibit unwanted materials from entering the bore of the handle. A ledge extends circumferentially about and within the bore of the handle and is operative to restrict lateral movement of the drive shaft when the second end portion of the drive shaft is moved into the cavity.

It is preferred that the annular driver member include a stubshaft extending coextensively along the axis of rotation. The stubshaft is operative to engage the first workpiece or a conventional socket which is operative to engage the first workpiece so that the first workpiece can be rotatably advanced about the second workpiece. An ejector mechanism is operative with the annular driver and the drive shaft whereby resiliently urging the first end portion of the drive shaft into the bore correspondingly urges the first workpiece, i.e. the conventional socket, to disengage from the annular driver member. It is preferred that the longitudinal axis of the handle is oriented perpendicularly to the axis of rotation of the annular driver member. It is also preferred that a portion of the handle disposed adjacent to the free distal end is knurled.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

A ratchet wrench of the present invention is adapted for use to engage a first workpiece so that the first workpiece can be rotatably advanced about a second workpiece. One of ordinary skilled in the art would appreciate that ratchet wrenches are typically adapted for use with a conventional socket which is operative to engage a first workpiece so that the first workpiece can be rotatably advanced about a second workpiece. Therefore, the features and advantages of the ratchet wrench of the present invention can be applied to either a ratchet wrench adapted to directly engage the first workpiece or a ratchet wrench adapted for use with a conventional socket that engages the first workpiece. Furthermore, the first and second workpieces described herein, are examples only. One of ordinary skill in the art would appreciate that a first workpiece could be a conventional nut or a head of the bolt while the second workpiece could be a shaft of the bolt or a threaded hole in a support structure. In all cases, however, the first and second workpieces are matably fastened to or unfastened from each other by rotational advancement.

Figure 1:
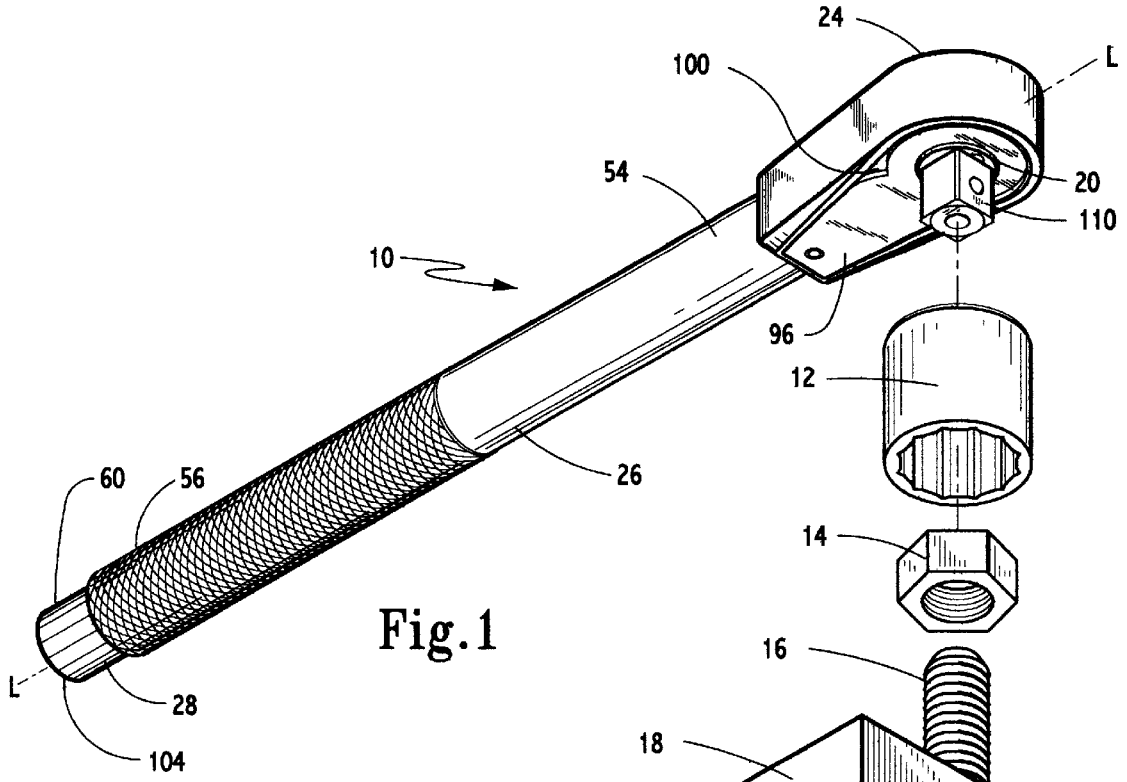
FIG. 1 is a perspective view of a ratchet wrench of the present invention with a stubshaft thereof aligned with a conventional socket, a conventional nut as a first workpiece and a conventional bolt as a second workpiece which is affixed to a support structure.

As shown in FIG. 1, ratchet wrench 10 of the present invention is adapted for use with a conventional socket 12 operative to engage a first workpiece 14 such as a threaded nut so that the first workpiece 14 can be rotatably advanced about a second workpiece 16 such as a threaded shaft of a bolt which is secured to a support structure 18. With reference to this Figure and FIGS. 2–9, it may be seen that ratchet wrench 10 includes an annular driver member 20, a pawl element 22, a housing 24, an elongated handle 26 and a drive shaft 28. Annular driver member 20 is operative to matably engage conventional socket 12 which is sized and adapted to matably engage first workpiece 14.

Annular driver member 20 has a plurality of peripheral teeth 30 and a plurality of end teeth 32. Peripheral teeth 30 are disposed circumferentially about a periphery of annular driver member 20 and end teeth 32 are disposed circumferentially about and extend outwardly from an annular flat surface 36 of annular driver member 20 parallel to an axis of rotation "A" of annular driver member 20. Pawl element 22 cooperates with driver member 20 to effect a ratcheting action. Here, pawl element 22 has a pair of shoulders 38 and 40 and a pair of nibs 42 and 44. Each of shoulders 38 and 40 is operative to matably engage sequential ones of peripheral teeth of annular driver member. Nibs 42 and 44 project from a flat surface 46 of pawl element 22 and extend parallel to a free pivotal axis "P" of pawl element 22.

Figures 2, 12, 13:
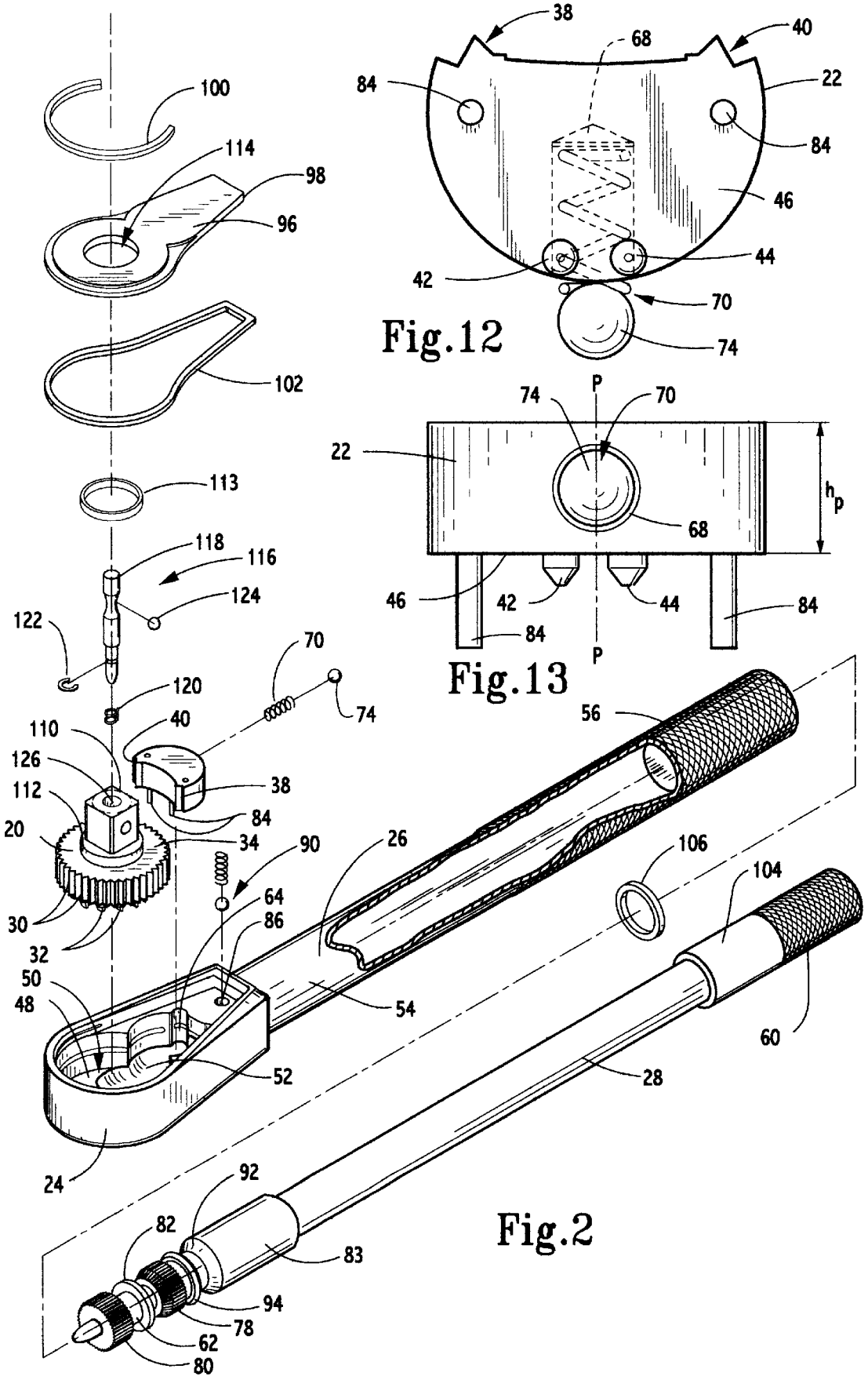
FIG. 2 is an exploded perspective view of the ratchet wrench of the present invention shown in FIG. 1.
FIG. 12 is a bottom plan view of the pawl element having a pair of pins and a pair of nibs and operative with the spring-ball assembly.
FIG. 13 is a rear elevational view of the pawl element shown in FIG. 12.

As best shown in FIG. 2, housing 24 has a cavity 48 which is divided into a first region 50 and a second region 52. First region 50 is sized and configured to rotatably receive annular driver member 20 so that peripheral teeth 30 and end teeth 32 can rotate about the axis of rotation "A" within cavity 48. Second region 52 is sized and configured to pivotally received pawl element 22 when annular driver member 20 is rotatably received in first region 50 so that nibs 42 and 44 of pawl element 22 can articulate within cavity 48 as particularly described hereinbelow. It should be noted that pawl element 22 is not constrained on a pivot axle, but rather is freely received in cavity region 52. Handle 26 has a proximal end 54 connected to housing 24 and extends along a longitudinal axis "L" from proximal end 54 to terminate in a free distal end 56. Handle 26 has a bore 58 which extends longitudinally therethrough and in communication with cavity 48 of housing 24.

Figure 3:
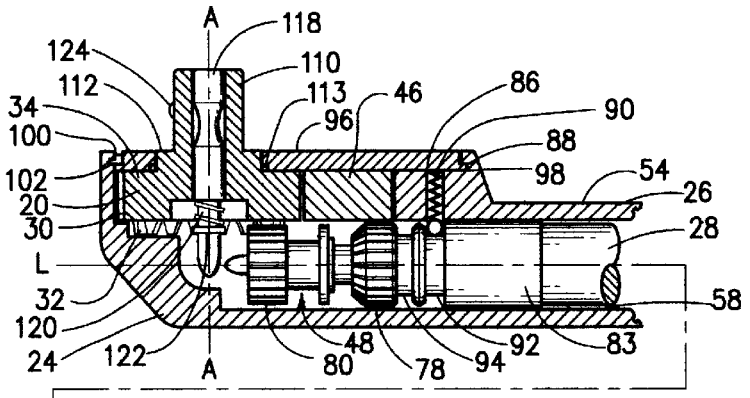
FIG. 3 is a side elevational view, partially in cross-section, of the ratchet wrench of the present invention in which the drive shaft is resiliently retained in a first linear position so that the ratchet wrench can operate in a first ratchet condition.
Figure 4:
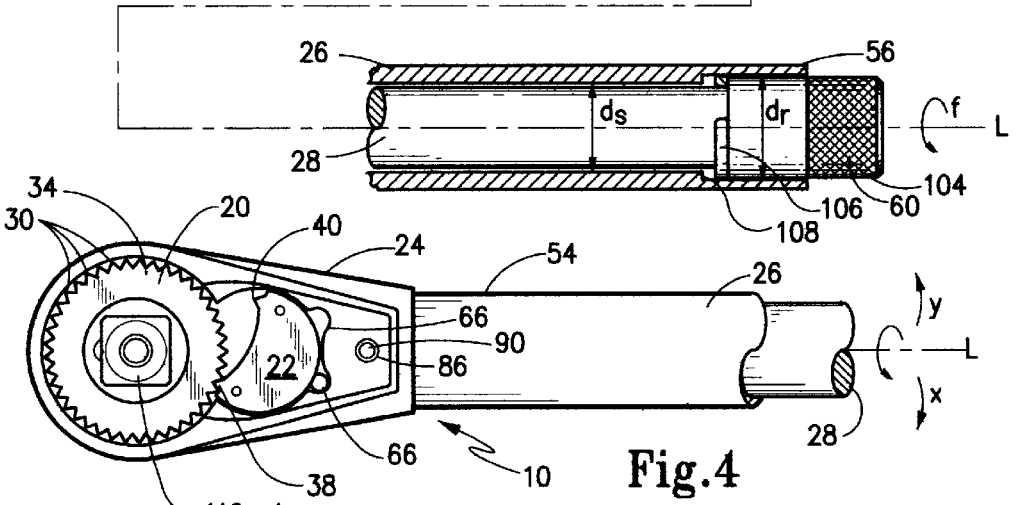
FIG. 4 is a top plan view of the ratchet wrench shown in FIG. 3 without a cover plate illustrating the annular driver member engaged with a pawl element in the first linear position shown in FIG. 3 whereby a first one of a pair of shoulders of a pawl element engages the annular driver member so that moving the handle in a first annular direction advances the first workpiece in the first angular direction and moving the handle in a second angular direction opposite the first angular direction causes select ones of peripheral teeth of the angular driver member to sequentially move past the first one of the pair of shoulders.
Figure 5:
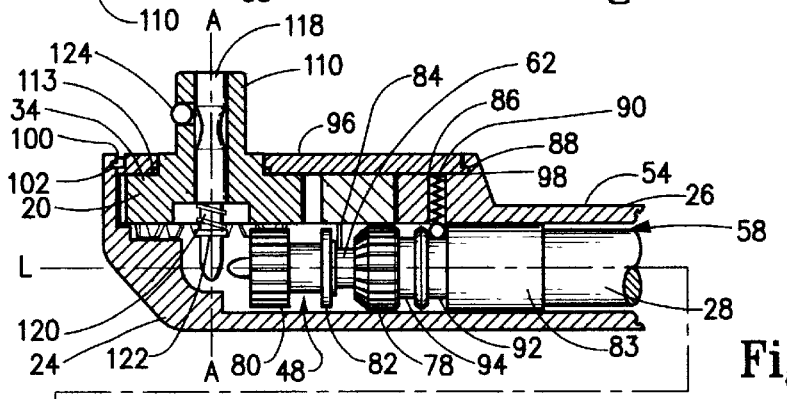
FIG. 5 is a side elevational view, partially in cross-section of the ratchet wrench of the present invention shown in FIG. 1 in which the drive shaft is resiliently retained in a second linear position so that the ratchet wrench can operate in a second ratchet condition.
Figure 6:
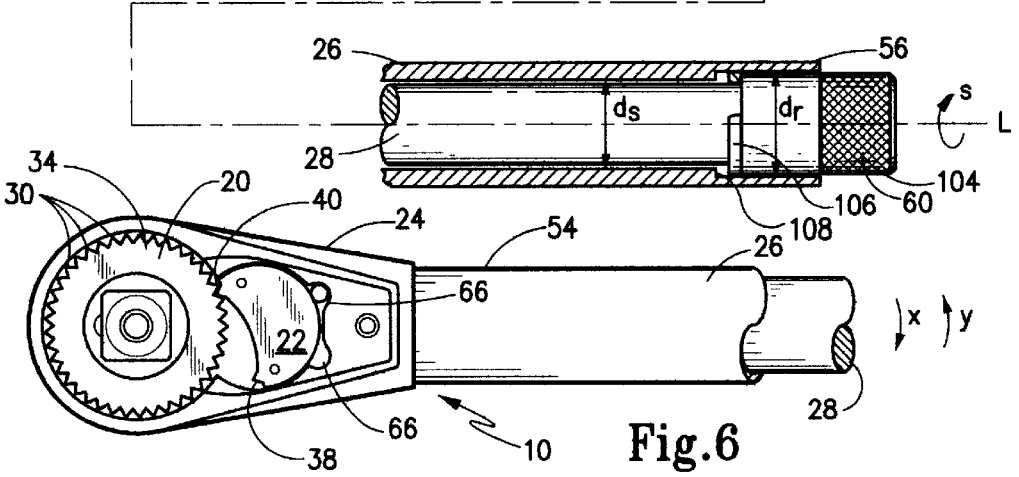
FIG. 6 is a partial top plan view of the ratchet wrench shown in FIG. 5 without the cover plate illustrating a second one of the pair of shoulders engaging the annular driver member so that moving the handle in the first angular direction causes select ones of the peripheral teeth to sequentially move past the second one of the pair of shoulders and moving the handle in the second angular direction advances the workpiece in the second angular direction.
Figure 7:
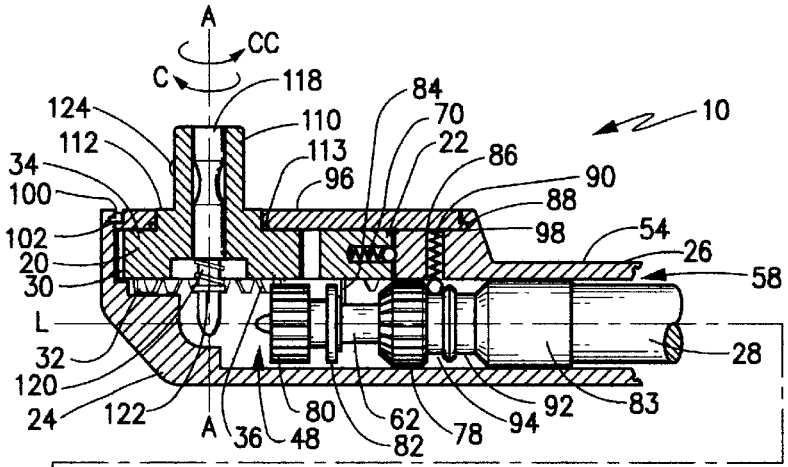
FIG. 7 is a side elevational view, partially in cross-section, of the ratchet wrench of the present invention in which the drive shaft is resiliently retained in a second linear position so that rotating the drive shaft simultaneously rotates the annular driver member.
Figure 8:
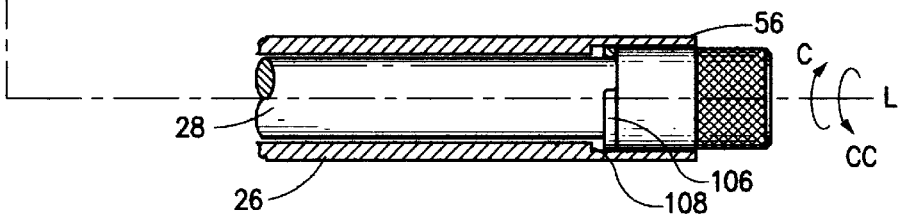
FIG. 8 is a top plan view of the ratchet wrench shown in FIG. 7 without the cover plate showing the pawl element being simultaneously retained in a disengaged condition from the annular driver member.
Figure 8:
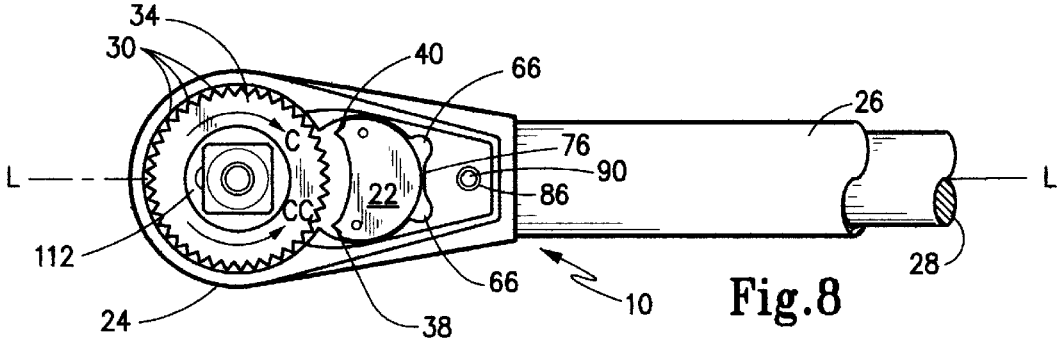
Figure 9:
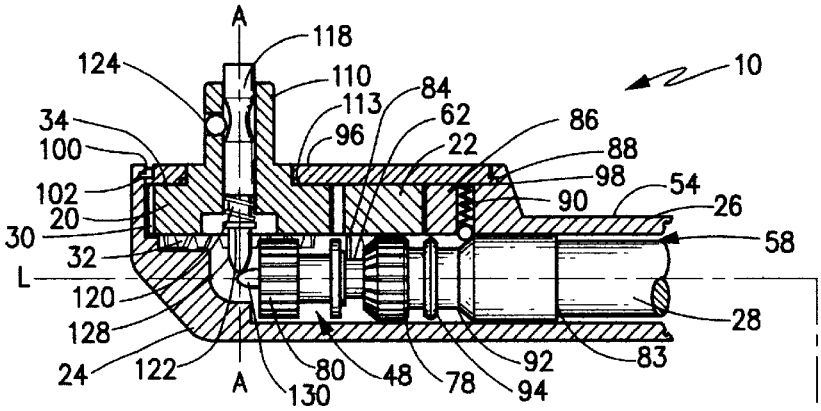
FIG. 9 is a side elevational view, partially in cross-section, of the ratchet wrench of the present invention showing the drive shaft in a forward position thereby actuating the ejector mechanism operative with the annular driver member.
Figure 9:
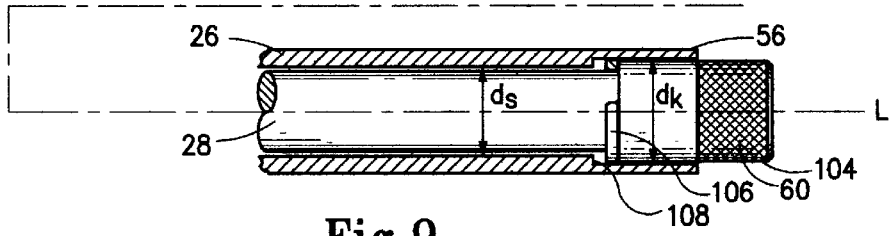

Drive shaft 28 is slidably and rotatably disposed within bore 58 of handle 26 along longitudinal axis "L" thereof. Drive shaft 28 has a first end portion 60 and a second end portion 62. First end portion 60 extends outwardly relative to free distal end 56 of handle 26 as best shown in FIGS. 1, 3, 5, 7 and 9. Second end portion 62 is disposed in cavity 48 as best shown in FIGS. 3, 5, 7 and 9. Drive shaft 28 is operative in a first linear position as illustrated in FIGS. 3, 4, 5, 6 and 9 and in a second linear position as illustrated in FIGS. 7 and 8. In the first linear position, rotating first end portion 60 of drive shaft 28 in a first direction "f" causes second end portion 62 of drive shaft 28 to pivot pawl element 22 into a first ratchet condition as shown in FIGS. 3 and 4. In the first ratchet condition, a first one of shoulders 38 and 40 of pawl element 22 engages annular driver member 20 so that moving handle 26 in a first angular direction "x" advances conventional socket 12 engaged with first workpiece 14 in the first angular direction "x" about second workpiece 16 and moving handle 26 in a second angular direction "y" opposite the first angular direction "x" causes selective ones of peripheral teeth 30 to ratchet, i.e., to sequentially move past the first one of shoulders 38 and 40. As shown in FIG. 5, rotating first end portion 60 of drive shaft 28 in a second direction "s" which is opposite the first direction "f" causes second end portion 62 of drive shaft 28 to pivot pawl element 22 into a second ratchet condition. In the second ratchet condition as shown in FIGS. 5 and 6, a second one of the pair of shoulders 38 and 40 engages annular driver member 20. Now, moving handle 26 in the first angular direction "x" causes selected ones of peripheral teeth 30 to sequentially move past the second one of shoulders 38 and 40 and moving handle 26 in the second angular direction "y" advances conventional socket 12 engaged with first workpiece 14 in the second angular direction "y" about second workpiece 16.

In the second linear position shown in FIGS. 7 and 8, second end portion 62 of drive shaft 28 engages end teeth 32 of annular driver member 20 and disengages from pawl element 22. Now, rotating first end portion 60 of drive shaft 28 in a clockwise direction "c" simultaneously rotates annular driver member 20 in a counterclockwise direction "cc" thereby rotatably advancing conventional socket 12 engaged with first workpiece 14 in the counterclockwise direction "cc". Rotating first end portion 60 in the counterclockwise direction "cc" simultaneously rotates annular driver member 20 in the clockwise direction "c" thereby rotatably advancing first workpiece 14 engaged with conventional socket 12 in the clockwise direction "c".

As best shown in FIG. 4, first shoulder 38 of pawl element 22 is resiliently urged into engagement with select sequential ones of peripheral teeth 30 of annular driver member 20 when in the first ratchet condition. As best shown in FIG. 6, second shoulder 40 of pawl element 22 is resiliently urged into engagement with select sequential ones of peripheral teeth 30 of annular driver member 20 when in the second ratchet condition. Peripheral teeth 30 are fully engaged with respective shoulders 38 and 40 of pawl element 22. In other words, each of peripheral teeth 30 of annular driver member 20 has a peripheral length "$h_a$" and each of shoulders 38 and 40 has a shoulder length "$h_s$" whereby peripheral height "$h_a$" and shoulder height "$h_s$" are equal. One of ordinary skill in the art would appreciate that respective shoulders 38 and 40 fully engaged with peripheral teeth 30 increases the mechanical strength of ratchet wrench 10.

Figure 10:
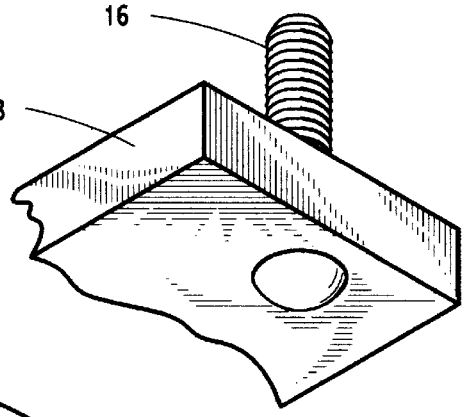
FIG. 10 is a perspective view, partially in cross-section, of the pawl element with a spring-ball assembly guided by a v-shaped groove formed into a surface defining a plurality of recesses.
Figure 10:
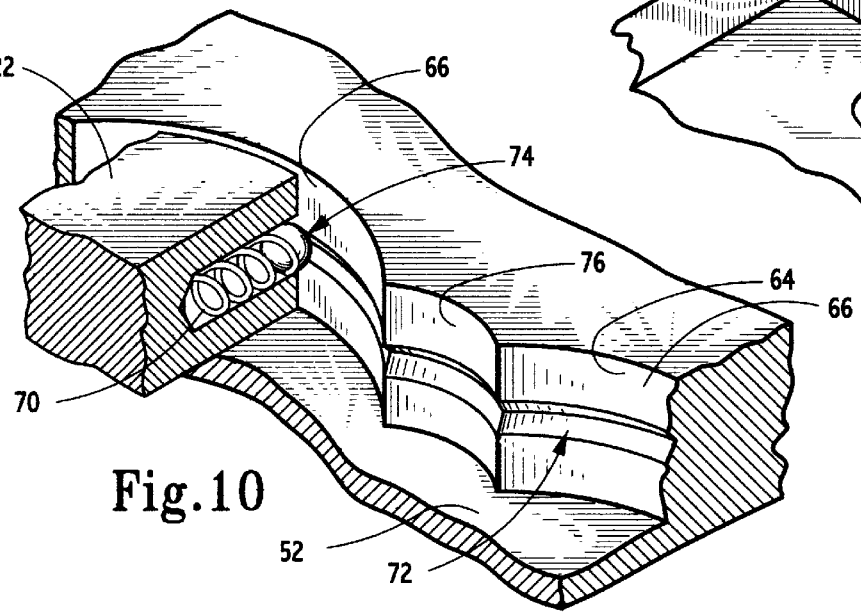
Figure 11:
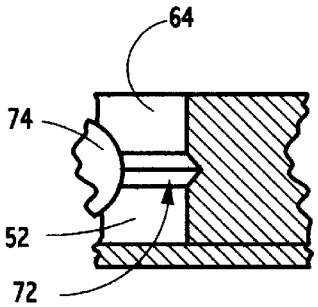
FIG. 11 is a side view in cross-section showing a ball of the spring-ball assembly following the v-shaped groove.

As shown in FIGS. 2, 10 and 11, housing 24 includes a curved wall 64 facing into cavity 48 and defining a pair of recesses 66 as shown in FIGS. 10–13, pawl element 22 includes an opening 68 which has a spring-ball assembly 70 operatively received thereinto. Spring-ball assembly 70 and opening 68 are cooperative with each of recesses 66 so that when pawl element 22 is in one of the first and second ratchet conditions, spring-ball assembly 70 resiliently urges respective ones of shoulders 38 and 40 of pawl element 22 into engagement with select sequential ones of peripheral teeth 30 of annular driver member 20. Curved wall 64 has a v-shaped groove 72 formed thereinto so that a ball 74 of spring-ball assembly 70 can move therealong and be self-centering to properly position pawl element 22.

Rotating drive shaft 28 in the first linear position between the first ratchet condition and the second ratchet condition defines a disengaged condition as best shown in FIG. 8. In the disengaged condition, pawl element 22 is disengaged from annular driver member 20. While in the disengaged condition and as long as drive shaft 28 is in the first linear position, annular driver member 20 can freely rotate within cavity 48 of housing 24. An intermediate recess 76 is formed into curved wall 64 to define a detent structure so that pawl element 22 can be resiliently retained in the disengaged condition. Pawl element 22 is resiliently retained in the disengaged condition as a result of spring-ball assembly 70 operating in cooperation with intermediate recess 76.

As best shown in FIGS. 2, 3, 5, 7 and 9, second end portion 62 of drive shaft 28 includes a first gear 78 and a second gear 80. First gear 78 and second gear 80 are rigidly disposed on drive shaft 28 for rotation about longitudinal axis "L". First gear 78 is operative to engage nibs 42 and 44 of pawl element 22 so that when drive shaft 28 is in the first linear position, pawl element 22 can be moved between the first ratchet condition and the second ratchet condition. In the second linear position, gear 78 disengages from nibs 42 and 44 of pawl element 22. Conversely, second gear 80 is operative when drive shaft 28 is in the second linear position to matably engage end teeth 32 of annular driver member 20 so that annular driver member 20 can rotate when first end portion 60 of drive shaft 28 rotates. When in the first linear position, gear 80 is disengaged from end teeth 32.

Figure 14:
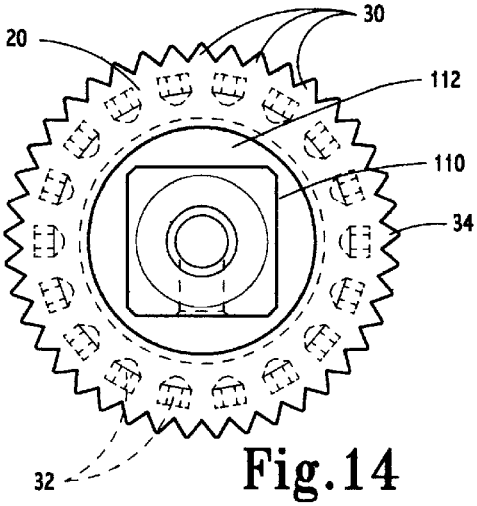
FIG. 14 is a top plan view of the angular driver member of the ratchet wrench shown in FIG. 1.
Figure 15:
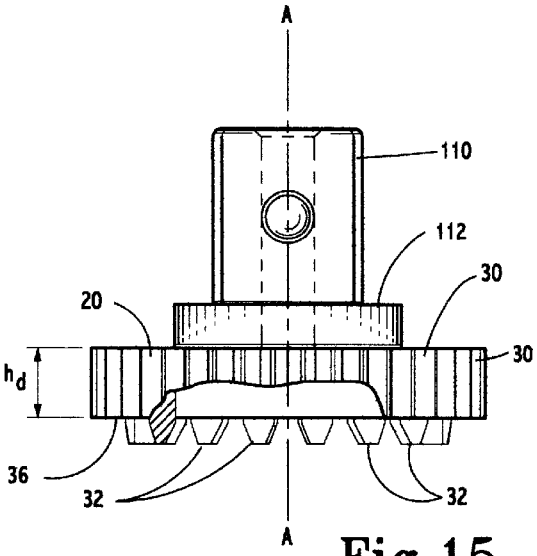
FIG. 15 is a side elevational view, partially broken away, of the annular driver member shown in FIG. 14.

As best shown in FIGS. 14 and 15, each of end teeth 32 tapers radially inwardly. Tapering end teeth 32 radially inwardly facilitates ease of engagement of end teeth 32 with second gear 80 when drive shaft 28 moves from the first linear position to the second linear position. Drive shaft 28 includes an enlarged shaft portion 83 extending longitudinally along and radially from drive shaft 28 within bore 58. Enlarged shaft portion 83 is disposed proximate to second end portion 62 of drive shaft 28. It is preferred that drive shaft 28 is fabricated as a unitary construction in order to reduced complications associated with assembling ratchet wrench 10 of the present invention. Second end portion 62 of drive shaft 28 includes a disk element 82 which is disposed between first gear 78 and second gear 80. Pawl element 22 also includes a pair of locating pins 84 which is best shown in FIGS. 12 and 13. The pair of pins 84 are spaced apart from one another and extend parallel to the pair of nibs 42 and 44. The pair of pins 84 are operative to contact disk element 82 to restrict linear movement of drive shaft 28 when first end portion 60 of drive shaft 28 is moved from the first linear position to the second linear position.

Ratchet wrench 10 includes a cover plate 96 which is releasably connected to housing 24. Cover plate 96 includes a lip 98 which is received by notch 88 formed in housing 24 when cover plate 96 is releasably connected to housing 24. A spring clip 100 is operative to releasably secure cover plate 96 onto housing 24. Additionally, a gasket element 102 is sized and adapted to be disposed between housing 24 and cover plate 96 when cover plate 96 is releasably connected thereto. Gasket element 102 is operative to inhibit unwanted materials such as dust particles and water from entering into cavity 48 when cover plate 96 is releasably connected to housing 24.

First end portion 60 of drive shaft 28 includes a knob 104 connected thereto. Knob 104 can be of integral unitary construction of drive shaft 28 or knob 104 can be a separate component fastened to first end portion 60 of drive shaft 28. Knob 104 is cylindrically shaped and has a diameter "$d_k$" larger than a diameter "$d^s$" of drive shaft 28. Knob 104 is sized to extend partially into bore 58 of handle 26 and at least a portion of knob 104 that extends outwardly from bore 58 is knurled. A knob seal element 106 depicted as a conventional O-ring, for example purposes only, extends around drive shaft 28 proximate to knob 104. Knob seal element 106 is operative to inhibit unwanted materials such as dust particles and water from entering bore 58 of handle 26. A ledge 108 extends circumferentially about and within bore 58. Ledge 108 is operative to restrict lateral movement of drive shaft 28 when second end portion 62 of drive shaft 28 is moved into cavity 48. Thus, ledge 108 acts as a stop to prevent knob 104 from further movement into bore 58. Also, knob seal element 106 acts as a damper in the event ratchet wrench 10 is dropped onto a solid surface at knob 104.

Annular driver member 20 includes a stubshaft 110 which extends therefrom coextensively along axis rotation "A" as best shown in FIGS. 14 and 15. Stubshaft 110 is operative to engage conventional socket 12. An annular pedestal 112 projects from annular driver member 20 coextensively along axis of rotation "A" and circumferentially about stubshaft 110. Annular pedestal 112 is sized and adapted so that it can be positioned in a cover plate hole 114 as best shown in FIG. 2. A second o-ring 113 fabricated from a typical sealing material such as rubber is disposed around annular pedestal 112 and is secured into position therearound by corner plate 96. Second o-ring 113 acts to inhibit unwanted materials such as dust particles and water from entering into cavity 48. It is preferred that longitudinal axis "L" of handle 26 is oriented perpendicularly to axis the rotation "A" of annular driver member 20. It is further preferred that a portion of handle 26 that is disposed adjacent to free distal end 56 of handle 26 is knurled.

Ratchet wrench 10 includes an ejector mechanism 116 which is operative with annular driver member 20 and drive shaft 28. By resiliently urging first end portion 60 of drive shaft 28 into bore 58 correspondingly urges conventional socket 12 to disengage from annular driver member 20. Ejector mechanism 116 includes a plunger 118 having an hour-glass shape, a spring 120, a retainer clip 122 and a retainer ball 124. Plunger 118 is slidably disposed in an axial passageway 126 which extends through stubshaft 110, annular pedestal 112 and annular driver member 20 along axis of rotation "A". Spring 120 is slidably received by plunger 118 and retainer clip 122 retains spring 120 thereon. In its normal socket retaining state, spring 120 provides a force so that retainer ball 124 is urged radially outwardly by plunger 118 to retain conventional socket 12 onto stubshaft 110. In its ejection state, a conical plunger end 128 of plunger 118 and a conical drive shaft end 130 contact each other when drive shaft 28 is moved forward and past the first linear position. A flat plunger end 118 projects from stubshaft 110 thereby ejecting conventional socket 12 therefrom while simultaneously causing retainer ball 124 to receive into axial passageway 126 thereby relieving the force against conventional socket 12.

Figure 17:
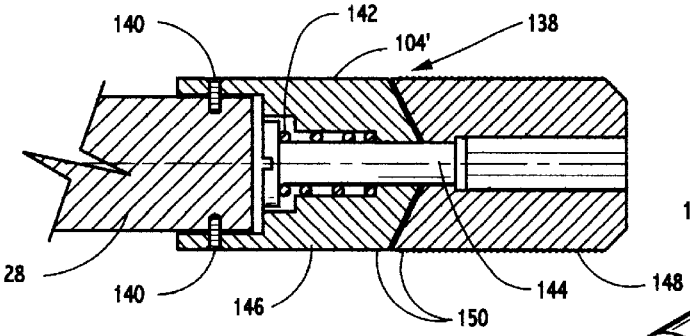
FIG. 17 is a side elevational view in cross-section of the knob with the clutch assembly of FIG. 16.
Figure 16:
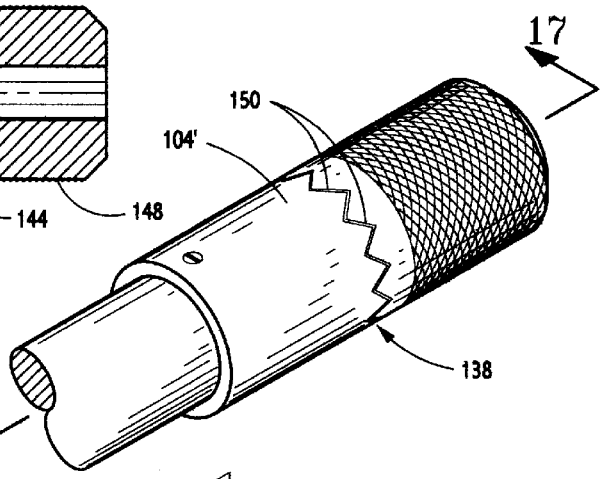
FIG. 16 is a perspective view of a knob having a clutch assembly which is connected to the first end portion of the drive shaft.
Figure 18:
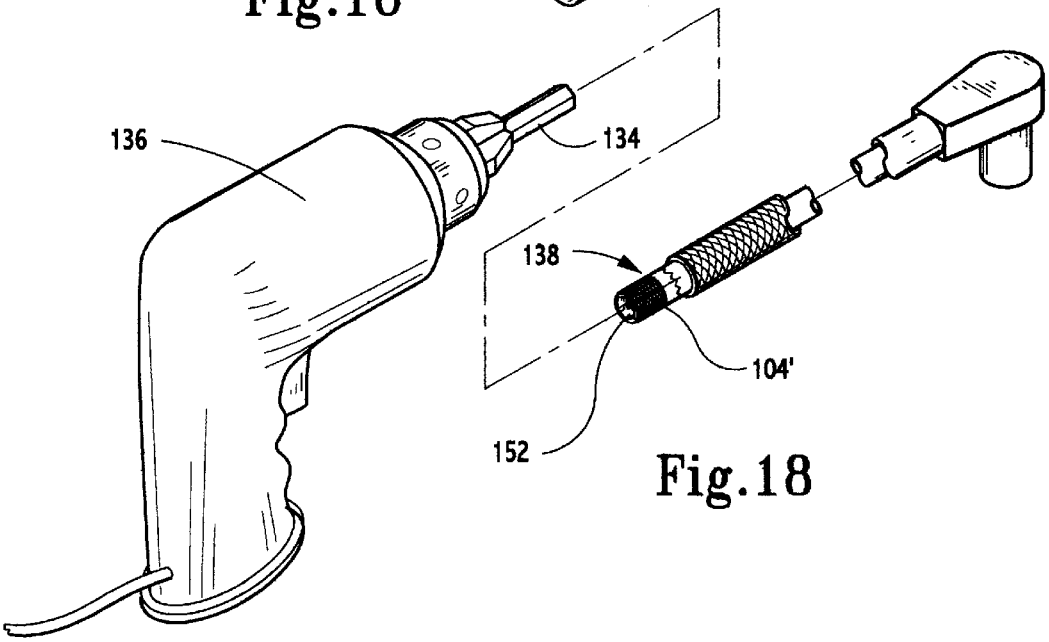
FIG. 18 is a perspective view of the knob with a clutch assembly depicting a non-circular hole formed thereunto and adapted to receive a tool element which is operative with a power tool device to rotate the knob.

With reference to FIGS. 16–18, an alternative knob 104' is depicted. Knob 104' is operative to receive a tool element having a non-circular cross-section which may be rotatably connected to a power tool device 136 such as a conventional electrical drill. With tool element 134 rotatably connected, power tool device 136 operates to automatically rotate drive shaft 28 when drive shaft 28 is disposed in the second linear position. Knob 104' includes a clutch assembly 138 which is operative to slip upon imparting a select torsional force to knob 104' by power tool device 136. Knob 104' is connected to drive shaft 28 by a pair of set screws 140 although one of ordinary skilled in the art would appreciate that any conventional clutch assembly would be adequate for use with the ratchet wrench of the present invention. A clutch spring 142 and a clutch bolt 144 are employed to connect a first knob portion 146 to a second knob portion 148. A matable set of radial teeth 150 is formed into each end of first knob portion 146 and second knob portion 148. A skilled artisan would appreciate that inserting tool element 134 into a matable hole 152 formed into second knob portion 148 and connecting power tool device 136 to tool element 134, a user can automatically rotate drive shaft 28 to cause annular driver member 20 to rotate when drive shaft 28 is disposed in the second linear position. When a select torsional force is exceeded, clutch assembly 138 slips to prevent both the ratchet wrench of the present invention and the workpieces from being damaged.

By minimizing the number of components of the ratchet wrench of the present invention, a skilled artisan would appreciate that such a ratchet wrench is easy to manufacture and simple to assemble. The ratchet wrench of the present invention is also sealed in order inhibit infiltration of unwanted materials such as dust particles and water into the cavity of the housing and the bore of the handle. Configuring the cavity of the housing to rotatably receive the annular driver member and to pivotally receive the pawl element, eliminates the need to employ a pivot pin so that the pawl element can pivot thereabout. Also, the configured cavity includes an intermediate recess so that the pawl element can be resiliently retained in the disengaged condition. The drive shaft is of unitary construction and is operative with the pawl element to effect ratcheting action, is operative with the annular driver member to effect rotation thereof and is operative with the ejector mechanism to eject a conventional socket releasably connected to the annular driver member. The spring-ball assembly operative with the pawl element, resiliently urges the shoulders of the pawl into engagement with select ones of peripheral teeth and also resiliently retains the pawl element in a disengaged condition. The housing spring-ball assembly is operative with the housing to resiliently retain the drive shaft in the first and second linear positions and is retained within the housing by the cover plate. Furthermore, the ejector mechanism is operative with the drive shaft to release and eject a conventional socket which is releasably engaged with the annular driver member of ratchet wrench of the present invention. Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A ratchet wrench wrench adapted for use to engage a first workpiece so that the first workpiece can be rotably advanced about a second workpiece comprising:

(a) an annular driver member operative to matably engage the first workpiece, said annular driver member having a plurality of peripheral teeth disposed circumferentially about said annular driver member and a plurality of end teeth disposed circumferentially about and extending from an annular flat surface of said annular driver member parallel to an axis of rotation of said annular driver member, each of said peripheral teeth having peripheral length;

(b) a pawl element having a pair of shoulders and a pair of nibs, each of said shoulders having a shoulder length equal to the peripheral length and each of said shoulders operative to selectively engage sequential ones of said peripheral teeth of said annular driver member, said nibs projecting from a flat surface of said pawl element and extending parallel to a pivotal axis of said pawl element;

(c) a housing having a cavity divided into a first region and a second region, said first region sized and configured to rotatably receive said annular driver member so that said peripheral teeth and said end teeth can rotate about said axis of rotation within said cavity, said second region sized and configured to pivotally receive said pawl element when said annular driver member is rotatably received in said first region so that said nibs and said shoulders of said pawl element can articulate within said cavity, said housing having a cover plate releasably connected thereto;

(d) a gasket element sized and adapted to be disposed between said housing and said cover plate when said cover plate is releasably connected thereto and operative to inhibit unwanted materials from entering into said cavity;

(e) an elongated handle having a proximal end connected to said housing and extending along a longitudinal axis from said proximal end to terminate in a free distal end, said handle having a bore extending longitudinally therethrough and in communication with said cavity of said housing; and (f) a drive shaft slidably and rotatably disposed within said bore of said handle along said longitudinal axis thereof and having a first end portion extending outwardly relative to said free distal end of said handle and a second end portion disposed in said cavity of said housing, said drive shaft operative in a first linear position and a second linear position whereby in the first linear position rotating said first end portion of said drive shaft in a first direction causes said second end portion of said drive shaft to pivot said pawl element into a first ratchet condition in which a first one of said shoulders of said pawl element is resiliently urged into engagement with select sequential ones of the peripheral teeth of said annular driver member so that moving said handle in a first angular direction advances the first workpiece in the first angular direction about the second workpiece and moving said handle in a second angular direction opposite said first angular direction causes selected ones of said peripheral teeth to sequentially move past said first one of said shoulders and rotating said first end portion of said drive shaft in a second direction opposite the first direction causes said second end portion of said drive shaft to pivot said pawl element into a second ratchet condition in which a second one of said pair of shoulders of said pawl element is resiliently urged into engagement with select sequential ones of the peripheral teeth of said annular driver member so that moving said handle in the first angular direction causes selected ones of said peripheral teeth to sequentially move past said second one of said shoulders and moving said handle in the second angular direction advances the first workpiece in the second angular direction about the second workpiece and whereby in the second linear position said second end portion engages said annular driver member so that rotating said first end portion in a clockwise direction simultaneously rotates said annular driver member in the counterclockwise direction thereby rotatably advancing the first workpiece in the counterclockwise direction and rotating said first end portion in the counterclockwise direction simultaneously rotates said annular driver member in the clockwise direction thereby rotatably advancing the workpiece in the clockwise direction.

2. A ratchet wrench according to claim 1 wherein said housing includes a curved wall facing into said cavity and defining a pair of recesses and wherein said pawl element includes an opening having a spring-ball assembly operatively received into said opening and cooperative with each of said recesses so that when said pawl element is in one of the first and second ratchet conditions said spring-ball assembly resiliently urges respective ones of said shoulders into engagement with select sequential ones of the peripheral teeth of said annular drive member.

3. A ratchet wrench adapted for use to engage a first workpiece so that the first workpiece can be rotatably advanced about a second workpiece, comprises:

(a) an annular driver member operative to matably engage the first workpiece, said annular driver member having a plurality of peripheral teeth disposed circumferentially about said annular driver member and a plurality of end teeth disposed circumferentially about and extending from an annular flat surface of said annular driver member parallel to an axis of rotation of said annular driver member, each of said peripheral teeth having peripheral length;

(b) a pawl element having a pair of shoulders and a pair of nibs, each of said shoulders having a shoulder length equal to the peripheral length and each of said shoulders operative to selectively engage sequential ones of said peripheral teeth of said annular driver member, said nibs projecting from a flat surface of said pawl element and extending parallel to a pivotal axis of said pawl element, said pawl element including a pair of locating pins spaced apart from one another and extending parallel to said pair of nibs;

(c) a housing having a cavity divided into a first region and a second region, said first region sized and configured to rotatably receive said annular driver member so that said peripheral teeth and said end teeth can rotate about said axis of rotation within said cavity, said second region sized and configured to pivotally receive said pawl element when said annular driver member is rotatably received in said first region so that said nibs and said shoulders of said pawl element can articulate within said cavity, said housing having a cover plate releasably connected thereto;

(d) a gasket element sized and adapted to be disposed between said housing and said cover plate when said cover plate is releasably connected thereto and operative to inhibit unwanted materials from entering into said cavity;

(e) an elongated handle having a proximal end connected to said housing and extending along a longitudinal axis from said proximal end to terminate in a free distal end, said handle having a bore extending longitudinally therethrough and in communication with said cavity of said housing; and (f) a drive shaft slidably and rotatably disposed within said bore of said handle along said longitudinal axis thereof and having a first end portion extending outwardly relative to said free distal end of said handle and a second end portion disposed in said cavity of said housing, said drive shaft operative in a first linear position and a second linear position whereby in the first linear position rotating said first end portion of said drive shaft in a first direction causes said second end portion of said drive shaft to pivot said pawl element into a first ratchet condition in which a first one of said shoulders of said pawl element is resiliently urged into engagement with select sequential ones of the peripheral teeth of said annular driver member so that moving said handle in a first angular direction advances the first workpiece in the first angular direction about the second workpiece and moving said handle in a second angular direction opposite said first angular direction causes selected ones of said peripheral teeth to sequentially move past said first one of said shoulders and rotating said first end portion of said drive shaft in a second direction opposite the first direction causes said second end portion of said drive shaft to pivot said pawl element into a second ratchet condition in which a second one of said pair of shoulders of said pawl element is resiliently urged into engagement with select sequential ones of the peripheral teeth of said annular driver member so that moving said handle in the first angular direction causes selected ones of said peripheral teeth to sequentially move past said second one of said shoulders and moving said handle in the second angular direction advances the first workpiece in the second angular direction about the second workpiece and whereby in the second linear position said second end portion engages said annular driver member so that rotating said first end portion in a clockwise direction simultaneously rotates said annular driver member in the counterclockwise direction thereby rotatably advancing the first workpiece in the counterclockwise direction and rotating said first end portion in the counterclockwise direction simultaneously rotates said annular driver member in the clockwise direction thereby rotatably advancing the first workpiece in the clockwise direction, said second end portion of said drive shaft including a first gear and a second gear, said first and second gears disposed for rotation about said longitudinal axis of said drive shaft, said first gear operative to move said nibs of said pawl element so that said pawl element can move between the first ratchet condition and the second ratchet condition, said second gear operative to matably engage said end teeth of said annular driver member so that said annular driver member can rotate when the first end portion of said drive shaft rotates, said second end portion of said drive shaft including a disk element disposed between said first and second gears and said locating pins of said pawl element operative to contact said disk element to restrict linear movement of said drive shaft when said first end portion of said drive shaft is moved from the first linear position to the second linear position.

4. A ratchet wrench adapted for use with a conventional socket operative to engage a first workpiece so that the first workpiece can be rotatably advanced about a second workpiece, comprising:

(a) an annular driver member operative to matably engage the conventional socket sized and adapted to matably engage the first workpiece, said annular driver member having a plurality of peripheral teeth disposed circumferentially about a periphery of said annular driver member and a plurality of end teeth disposed circumferentially about and extending from an annular flat surface of said annular driver member parallel to an axis of rotation of said annular driver member;

(b) a pawl element having a pair of shoulders and a pair of nibs, each of said shoulders operative to matably engage sequential ones of said peripheral teeth of said annular driver member, said nibs projecting from a flat surface of said pawl element and extending parallel to a pivotal axis of said pawl element;

(c) a housing having a cavity divided into a first region and a second region, said first region sized and configured to rotatably receive said annular driver member so that said peripheral teeth and said end teeth can rotate about said axis of rotation within said cavity, said second region sized and configured to pivotally receive said pawl element when said annular driver member is rotatably received in said first region so that said nibs of said pawl element can articulate within said cavity;

(d) an elongated handle having a proximal end connected to said housing and extending along a longitudinal axis from said proximal end to terminate in a free distal end, said handle having a bore extending longitudinally therethrough and in communication with said cavity of said housing;

(e) a drive shaft slidably and rotatably disposed within said bore of said handle along said longitudinal axis thereof and having a first end portion extending outwardly relative to said free distal end of said handle and a second end portion disposed in said cavity of said housing, said drive shaft operative in a first linear position and a second linear position whereby in the first linear position rotating said first end portion of said drive shaft in a first direction causes said second end portion of said drive shaft to pivot said pawl element into a first ratchet condition in which a first one of said shoulders of said pawl element engages said annular driver member so that moving said handle in a first angular direction advances the socket engaged with the first workpiece in the first angular direction about the second workpiece and moving said handle in a second angular direction opposite said first angular direction causes selected ones of said peripheral teeth to sequentially move past said first one of said shoulders and rotating said first end portion in a second direction opposite the first direction causes said second end portion of said drive shaft to pivot said pawl element into a second ratchet condition in which a second one of said pair of shoulders engages said annular driver member so that moving said handle in the first angular direction causes selected ones of said peripheral teeth to sequentially move past said second one of said shoulders and moving said handle in the second angular direction advances the socket engaged with the first workpiece in the second angular direction about the second workpiece and whereby in the second linear position said second end portion engages said annular driver member so that rotating said first end portion in a clockwise direction simultaneously rotates said annular driver member in a counterclockwise direction thereby rotatably advancing the first workpiece engaged with the socket in the counterclockwise direction and rotating said first end portion in the counterclockwise direction simultaneously rotates said annular driver member in the clockwise direction thereby rotatably advancing the first workpiece engaged with the socket in the clockwise direction; and (f) a knob connected to the first end portion of said drive shaft and sized to extend partially into said bore of said handle, said knob operative to receive a tool element rotatably connected to a power tool device to automatically rotate said drive shaft when said drive shaft is disposed in the second linear position, said knob including a clutch assembly operative to slip upon imparting a select torsional force to said knob by the power tool device.

5. A ratchet wrench according to claim 4 wherein at least a portion of said knob extending outwardly from said bore is knurled.

6. A ratchet wrench according to claim 4 wherein said knob is cylindrically shaped, said knob having a diameter larger than said drive shaft.

7. A ratchet wrench according to claim 4 including a knob seal element extending around said drive shaft proximate said knob and is operative to inhibit unwanted materials from entering said bore of said handle.

8. A ratchet wrench according to claim 4 including a ledge extending circumferentially about and within said bore, said ledge operative to restrict lateral movement of said drive shaft when said second end portion of said drive shaft is moved into said cavity.

9. A ratchet wrench adapted for use with a conventional socket operative to engage a first workpiece so that the first workpiece can be rotatably advanced about a second workpiece, comprising:

(a) an annular driver member operative to matably engage the conventional socket sized and adapted to matably engage the first workpiece, said annular driver member having a plurality of peripheral teeth disposed circumferentially about a periphery of said annular driver member and a plurality of end teeth disposed circumferentially about and extending from an annular flat surface of said annular driver member parallel to an axis of rotation of said annular driver member, each of said peripheral teeth having a peripheral length and a peripheral height;

(b) a pawl element having a pair of shoulders and a pair of nibs, each of said shoulders having a shoulder length equal to said peripheral length and a shoulder height equal to said peripheral height, each of said shoulders operative to matably engage sequential ones of said peripheral teeth of said annular driver member, said nibs projecting from a flat surface of said pawl element and extending parallel to a pivotal axis of said pawl element;

(c) a housing having a cavity divided into a first region and a second region, said first region sized and configured to rotatably receive said annular driver member so that said peripheral teeth and said end teeth can rotate about said axis of rotation within said cavity, said second region sized and configured to pivotally receive said pawl element when said annular driver member is rotatably received in said first region so that said nibs of said pawl element can articulate within said cavity;

(d) an elongated handle having a proximal end connected to said housing and extending along a longitudinal axis from said proximal end to terminate in a free distal end, said handle having a bore extending longitudinally therethrough and in communication with said cavity of said housing; and (e) a drive shaft slidably and rotatably disposed within said bore of said handle along said longitudinal axis thereof and having a first end portion extending outwardly relative to said free distal end of said handle and a second end portion disposed in said cavity of said housing, said drive shaft operative in a first linear position and a second linear position whereby in the first linear position rotating said first end portion of said drive shaft in a first direction causes said second end portion of said drive shaft to pivot said pawl element into a first ratchet condition in which a first one of said shoulders of said pawl element engages said annular driver member so that moving said handle in a first angular direction advances the socket engaged with the first workpiece in the first angular direction about the second workpiece and moving said handle in a second angular direction opposite said first angular direction causes selected ones of said peripheral teeth to sequentially move past said first one of said shoulders and rotating said first end portion in a second direction opposite the first direction causes said second end portion of said drive shaft to pivot said pawl element into a second ratchet condition in which a second one of said pair of shoulders engages said annular driver member so that moving said handle in the first angular direction causes selected ones of said peripheral teeth to sequentially move past said second one of said shoulders and moving said handle in the second angular direction advances the socket engaged with the first workpiece in the second angular direction about the second workpiece and whereby in the second linear position said second end portion engages said annular driver member so that rotating said first end portion in a clockwise direction simultaneously rotates said annular driver member in a counterclockwise direction thereby rotatably advancing the first workpiece engaged with the socket in the counterclockwise direction and rotating said first end portion in the counterclockwise direction simultaneously rotates said annular driver member in the clockwise direction thereby rotatably advancing the first workpiece engaged with the socket in the clockwise direction.

10. A ratchet wrench according to claim 9 wherein said first shoulder of said pawl element is resiliently urged into engagement with select sequential ones of peripheral teeth of said annular driver member when in the first ratchet condition and wherein said second shoulder of said pawl element is resiliently urged into engagement with select sequential ones of peripheral teeth of said annular driver member when in the second ratchet condition.

11. A ratchet wrench according to claim 10 wherein said housing includes a curved wall facing into said cavity and defining a pair of recesses and wherein said pawl element includes an opening having a spring-ball assembly operatively received into said opening and cooperative with each of said recesses so that when said pawl element is in one of the first and second ratchet conditions said spring-ball assembly resiliently urges respective ones of said shoulders into engagement with select sequential ones of peripheral teeth of said annular driver member.

12. A ratchet wrench according to claim 9 wherein rotating said drive shaft in the first linear position between the first ratchet condition and the second ratchet condition defines a disengaged condition whereby said pawl element is disengaged from said annular driver member so that said annular driver member can freely rotate within said cavity of said housing, said pawl element being resiliently retained in the disengaged condition.

13. A ratchet wrench according to claim 9 including a cover plate releasably connected to said housing.

14. A ratchet wrench according to claim 13 including a gasket element sized and adapted to be disposed between said housing and said cover plate when said cover plate is releasably connected thereto and operative to inhibit unwanted materials from entering into said cavity.

15. A ratchet wrench according to claim 9 including a spring clip operative to releasably secure said cover plate onto said housing.

16. A ratchet wrench according to claim 9 wherein said second end portion of said drive shaft includes a first gear and a second gear, said first and second gears disposed for rotation about said longitudinal axis of said drive shaft, said first gear operative to move said nibs of said pawl element so that when said drive shaft is in the first linear position said pawl element can move between the first ratchet condition and the second ratchet condition, 10 said second gear operative when said drive shaft is in the second linear position to matably engage said end teeth of said annular driver member so that said annular driver member can rotate when first end portion of said drive shaft rotates.

17. A ratchet wrench according to claim 9 wherein said second end portion of said drive shaft includes a disk element disposed between said first and second gears and wherein said pawl element includes a pair of pins spaced apart from one another and extending parallel to said pair of nibs, said pair of pins operative to contact said disk element to restrict linear movement of said drive shaft when said first end portion of said drive shaft is moved from the first linear position to the second linear position.

18. A ratchet wrench according to claim 9 wherein said housing includes a hole having a housing spring-ball assembly operatively received therein and said drive shaft includes a pair of grooves extending circumferentially about said second end portion of said drive shaft and disposed adjacent to each other in a spaced-apart relationship, said housing spring-ball assembly and said pair of grooves are operative to cooperate with each other so that said drive shaft can be selectively and resiliently retained in one of the first linear position and the second linear position.

19. A ratchet wrench according to claim 9 wherein said drive shaft includes an enlarged shaft portion extending longitudinally along and radially from said drive shaft within said bore, said enlarged shaft portion being disposed proximate to said second end portion of said drive shaft.

20. A ratchet wrench according to claim 9 wherein said first end portion of said drive shaft includes a cylindrically-shaped knob connected thereto, said knob sized to extend partially into said bore of said handle, said knob having a diameter larger than said drive shaft and having at least a knurled portion extending outwardly from said bore.

21. A ratchet wrench according to claim 20 wherein said knob is operative to receive a tool element rotatably connected to a power tool device to automatically rotate said drive shaft when said drive shaft is disposed in the second linear position, said knob including a clutch assembly operative to slip upon imparting a select torsional force to said knob by the power tool device.

22. A ratchet wrench according to claim 21 including a knob seal element extending around said drive shaft proximate said knob and is operative to inhibit unwanted materials from entering said bore of said handle.

23. A ratchet wrench according to claim 22 including a ledge extending circumferentially about and within said bore, said ledge operative to restrict lateral movement of said drive shaft when said second end portion of said drive shaft is moved into said cavity.

24. A ratchet wrench according to claim 9 wherein said annular driver member includes a stubshaft extending therefrom coextensively along said axis of rotation and operative to engage the socket. socket to disengage said annular driver member.

25. A ratchet wrench according to claim 9 wherein said longitudinal axis of said handle is oriented perpendicularly to said axis of rotation of said annular driver member.

26. A ratchet wrench according to claim 9 wherein a portion of said handle disposed adjacent to said free distal end is knurled.

* * * * *